US007845018B1

(12) United States Patent
Greer

(10) Patent No.: US 7,845,018 B1
(45) Date of Patent: Dec. 7, 2010

(54) DIRECTIONAL SAFETY VEST

(76) Inventor: Ronald H. Greer, 478 CR 640, Dayton, TX (US) 77535

( * ) Notice: Subject to any disclaimer, the term of this patent is extended or adjusted under 35 U.S.C. 154(b) by 52 days.

(21) Appl. No.: 12/031,062

(22) Filed: Feb. 14, 2008

(51) Int. Cl.
*A41D 13/00* (2006.01)

(52) U.S. Cl. ..... 2/102

(58) Field of Classification Search ..... 2/69, 2/102, 247, 94, 85, 93, 115, 108
See application file for complete search history.

(56) References Cited

U.S. PATENT DOCUMENTS 4,328,533 A 5/1982 Paredes
4,453,274 A 6/1984 Allen
4,796,304 A 1/1989 Shelby
5,070,436 A 12/1991 Alexander et al.
5,695,853 A 12/1997 Billingsley et al.
5,746,632 A 5/1998 Theberge
5,893,786 A 4/1999 Stevens
6,182,291 B1 2/2001 Garvey
6,769,138 B2 8/2004 Golle et al.
6,892,394 B2 * 5/2005 Grilliot et al. ..... 2/81
7,111,327 B1 * 9/2006 Blauer et al. ..... 2/82
7,144,127 B2 12/2006 Golle et al.
7,147,339 B2 12/2006 Golle et al.
7,229,183 B2 6/2007 Golle et al.
7,229,184 B2 6/2007 Golle et al.

* cited by examiner

*Primary Examiner*—Tejash Patel
(74) *Attorney, Agent, or Firm*—Eric Karich

(57) ABSTRACT

A directional safety vest has a vest body adapted to cover a human torso. A front panel of the vest has a first fluorescent color. A back panel of the vest body has a second fluorescent color which is different from the first fluorescent color.

11 Claims, 3 Drawing Sheets

DIRECTIONAL SAFETY VEST

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to safety vests, and more particularly to a directional safety vest that facilitates rescues based upon different fluorescent colors provided on the front and back of the vest.

2. Description of Related Art

The following art defines the present state of this field:

Garvey, U.S. Pat. No. 6,182,291, teaches a hunting vest having a base fabric material. Flaps are provided on the front and on the back of the vest. The flaps are specifically designed to have a camouflage color on one side, and a blaze orange color on the opposite side. The flaps are detachably attached to the vest so that either color is visible, dependent on the choice of the hunter. It is possible to configure the Garvey vest so that the front is a bright fluorescent color and the back is camouflaged, or vice versa.

Allen, U.S. Pat. No. 4,453,274, teaches an upper-body garment, such as an athletic jersey, that has a facility whereby its characteristic color may be changed so that a wearer while participating in a team sport may switch teams without having to change jerseys. The garment has an inner shell and an outer shell. The outer shell comprises front and rear panels having one color on the outside and another color on the inside which is the same as the color of the inner shell. The panels may be attached together over the shoulders when the one color is to be exposed, and the panels may be detached so as to hang down from a midriff section of the garment when the other color is to be exposed. The garment is designed such that only one color shows at a time.

Theberge, U.S. Pat. No. 5,746,632, teaches a floatation aid useful for swimming instruction and which includes a harness and two floatation devices. In one embodiment the floatation devices are positioned over the chest and the lower back of a person.

Shelby, U.S. Pat. No. 4,796,304, teaches a hunting apron or vest having a base material which is cut and fashioned into the general overall shape of the apron or vest, to which, over a substantial majority of the outer surface, is loosely attached a net-like mesh material. The purpose of the loosely attached mesh material is to form pockets into which game, food, equipment and other items can be carried while a hunter, or other user, wears the apron or vest. The vest may be made in any color or combination of colors for safety reasons.

Golle et al., U.S. Pat. No. 7,229,184, teaches a safety vest having a front and back and left and right sides each having a shoulder portion. An EL strip is provided on each side of the vest extending from the bottom of the vest upwards toward the shoulder portion. See also Golle et al., U.S. Pat. No. 7,229,183, U.S. Pat. No. 7,147,339, U.S. Pat. No. 7,144,127, and U.S. Pat. No. 6,769,138.

Stevens, U.S. Pat. No. 5,893,786, teaches an automatic, telescoping, buoyant identification device for use with a water sports life vest. A spotting pole, constructed of a buoyant foam, slides freely within a tubular main housing such that when the wearer becomes submerged, the spotting pole automatically telescopes from the main housing into the air. The identification device is colored in a manner such that it will be highly visible to approaching boaters.

The above-described references are hereby incorporated by reference in full.

The prior art teaches different types of vests which utilize color. However, the prior art does not teach simultaneously showing a first fluorescent color on a front panel and a second fluorescent color different from the first fluorescent color on the back panel. The present invention fulfills these needs and provides further related advantages as described in the following summary.

SUMMARY OF THE INVENTION

The present invention teaches certain benefits in construction and use which give rise to the objectives described below.

The present invention provides a directional safety vest that includes a vest body adapted to cover a human torso. A front panel of the vest has a first fluorescent color. A back panel of the vest body has a second fluorescent color which is different from the first fluorescent color.

A primary objective of the present invention is to provide a directional safety vest having advantages not taught by the prior art.

Another objective is to provide a safety vest having different colors on the front and back panel to indicate the orientation of the person wearing the safety vest.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a directional safety vest 10. The directional safety vest 10, works to indicate to observers the orientation of a person 12 wearing the safety vest 10. This can be useful in different situations; for example, on a construction site, the orientation of the person 12 may help others to determine what the person is doing and whether he or she might be in danger. When the person 12 is in the water, the orientation of the person 12 may indicate whether the person 12 is in danger, and if a rescue is required, it may help determine how the rescue should take place.

Figure 1:
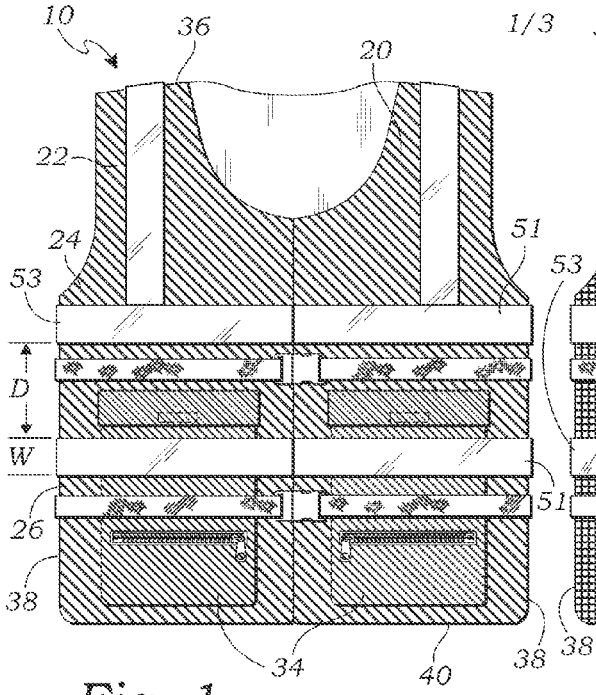
FIG. 1 is a front view of a safety vest according to an embodiment of the present invention.
Figure 2:
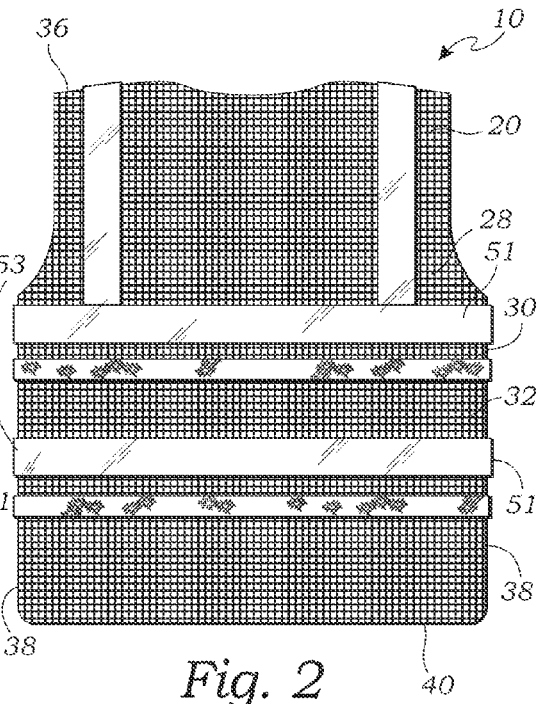
FIG. 2 is a back view thereof.

FIG. 1 is a front view of the safety vest 10 according to an embodiment of the present invention, and FIG. 2 is a back view thereof. As shown in FIGS. 1 and 2, the safety vest 10 has a vest body 20 adapted to cover a human torso. A front panel 22 of the vest body 20 is constructed of a first high visibility fabric 24 having a first fluorescent color 26. A back panel 28 of the vest body 20 is constructed of a second high visibility fabric 30 having a second fluorescent color 32 being different from the first florescent color 26. It is not necessary that the entirety of the front and back panels 22 and 28 be a uniform color, only that enough of the panels 22 and 28 be the first and second fluorescent colors 26 and 32 to enable the person to be easily spotted, and to enable the front and back of the person to be readily distinguished, as described in greater detail below.

For purposes of this application, the term "fluorescent color" is hereby defined to include any extremely bright safety colors that are commonly used in safety vests or equipment, and does not require that the colors actually fluoresce. The term expressly excludes low visibility colors and color schemes, such as camouflage patterns. The term "vest" is hereby defined to include any article of clothing that is worn on the human torso, also including jackets, tool or construction vests, rain-clothes, and related clothing.

As shown in FIGS. 1 and 2, the front panel 22 of the vest body 20 is a different color from the back panel 28 so that someone looking at the safety vest 10 can infer the orientation of the person wearing the safety vest 10. In the present embodiment, the first florescent color 26 includes green and the second fluorescent color 32 includes yellow, orange, or red. Although these colors are used in this embodiment, any other suitable colors could be used so long as the first florescent color 26 is different from the second fluorescent color 32.

In one embodiment, the safety vest 10 has a plurality of utility pockets 34 attached to the front panel 22 of the vest body 20. As shown in FIG. 1, the utility pockets 34 allow the storage of a variety of materials along the front panel 22 of the vest body 20.

Figure 3:
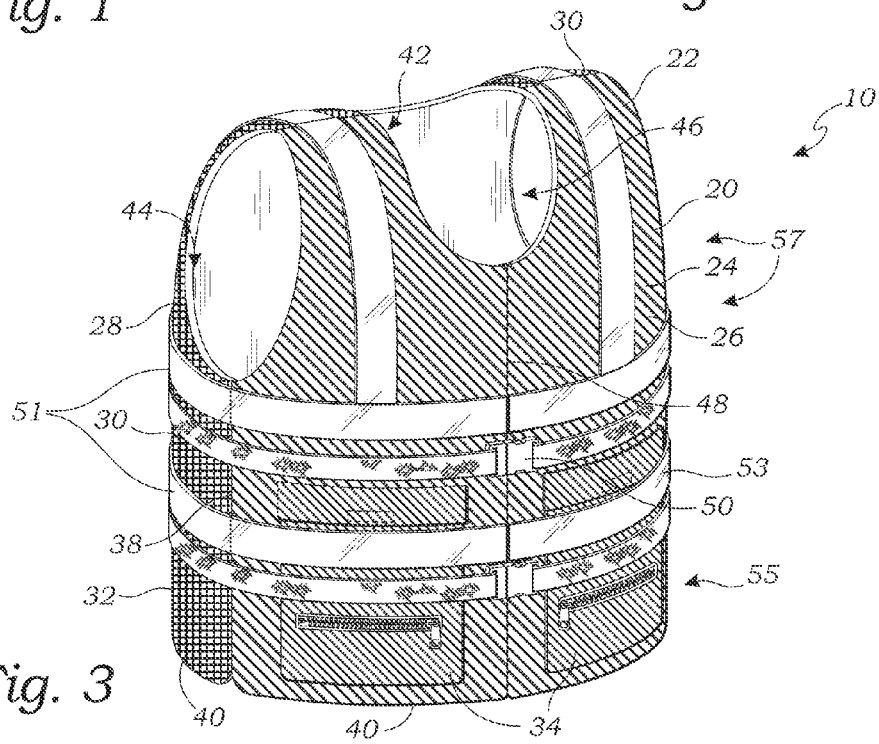
FIG. 3 is a perspective view thereof.

As shown in FIGS. 1 and 2, the front and back panels 22 and 28 are bounded by a top edge 36, a pair of side edges 38, and a bottom edge 40. FIG. 3 is a perspective view of the safety vest 10. As shown in FIG. 3, the top edges 36 of the front and back panels 22 and 28 are connected to form a collar aperture 42. The respective side edges 38 of the front and back panels 22 and 28 are connected such that a first and second arm apertures 44 and 46 are formed. In the embodiment shown in the FIG. 3, the safety vest 10 includes an opening 48 in the front panel 22 adapted for putting the vest on the person 12 and a fastener 50 for releasably connecting the opening 48 in a closed position. In this manner, the vest body 20 is adapted to cover the human torso.

As shown in FIGS. 1-3, the safety vest 10 further includes a band 51 (or a plurality of bands) of retroreflective material 53 on the vest body 20. The retroreflective material 53 acts to reflect any light that hits the vest body 20. The first and second high visibility fabrics 24 and 30 may have a combined area 55 such that the area 55 is at least 217 in.$^2$, 775 in.$^2$, or 1240 in.$^2$ depending on the desired visibility of the person 12 wearing the safety vest 10. In these cases, the retroreflective material 53 may have an area 57 of at least 155 in.$^2$, 201 in.$^2$, or 310 in.$^2$ respectively. The bands 51 may have a width W of least 25 mm, 35 mm, or 50 mm respectively. When the bands 51 are in horizontal orientation, the bands 51 may encircle the torso of the person 12 to provide 360° a visible reflective material 53, be at least 15 mm from the bottom 40 of the vest body 20, and be separated by distance D at least equal to the width W of the bands. While these specifications are discussed, any proper area or width that is known in the art can be used depending upon desired visibility factor of the user.

Figure 4:
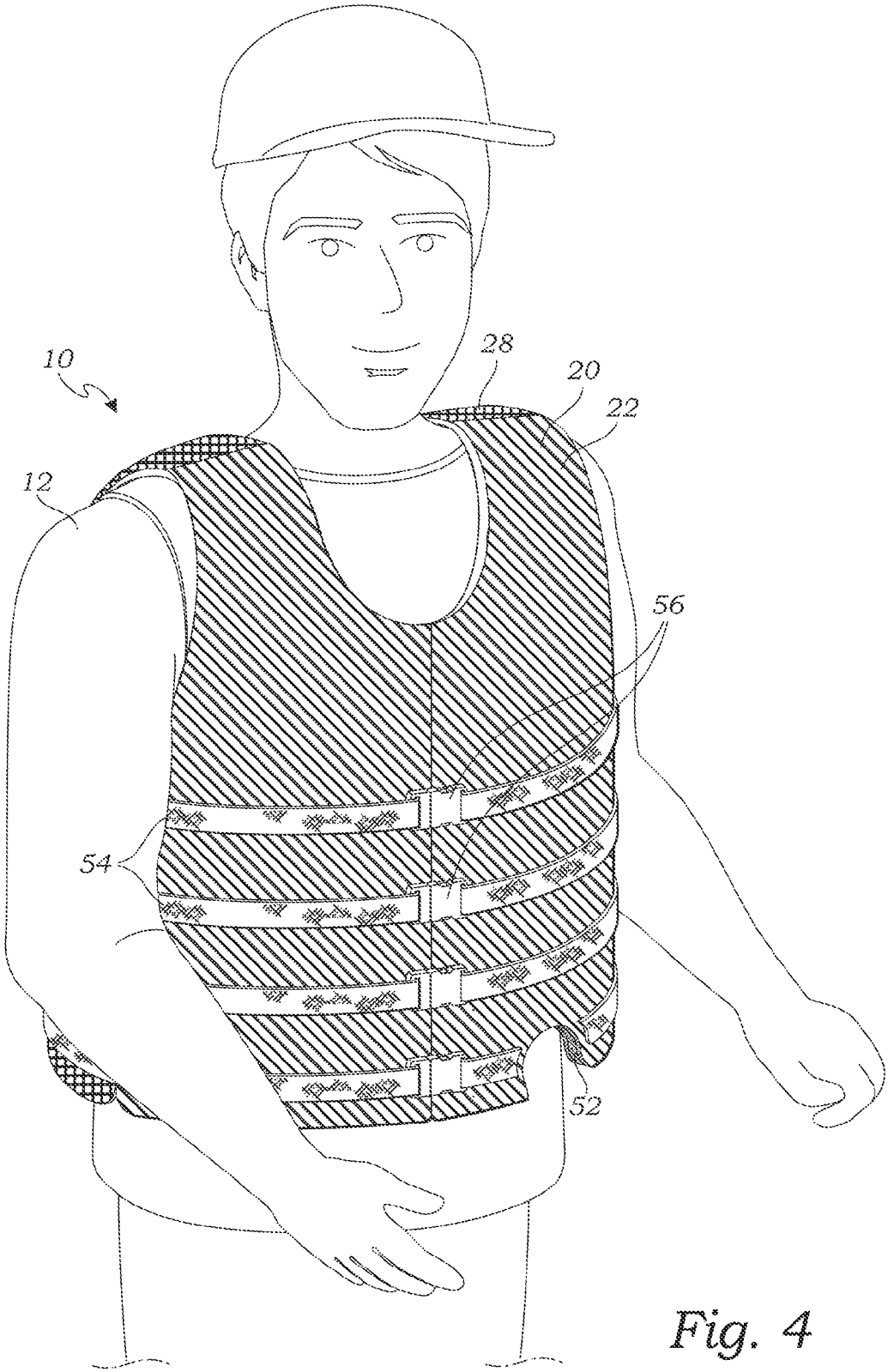
FIG. 4 is a perspective view of a person wearing a flotation vest according to an alternative embodiment of the present invention.

FIG. 4 is a perspective view of a person 12 wearing the safety vest 10. In the embodiment of FIG. 4, the safety vest 10 is a flotation vest. As shown in FIG. 4, the vest body 20 may be filled with a buoyant filling 52. In the embodiment of FIG. 4, the fastener 50 is a plurality of straps 54 that wrap around the front and back panels 22 and 28 and releasably fasten at the front panel 22 with buckles 56. While buckles 56 are shown here, any other type of closure may be used, including but not limited to ties, zippers, hooks and loops fasteners (Velcro®), and/or snaps.

The term "buoyant filling" is hereby defined to include any form of buoyant material, and also including compartments and or bladders for holding buoyant materials, air, or any other similar or related system for providing floatation. In one embodiment, the buoyant filling 52 may be made of polyurethane foam or polyvinyl chloride, although any suitable buoyant material used in the art could be employed for use in the flotation vest 10.

Figure 5:
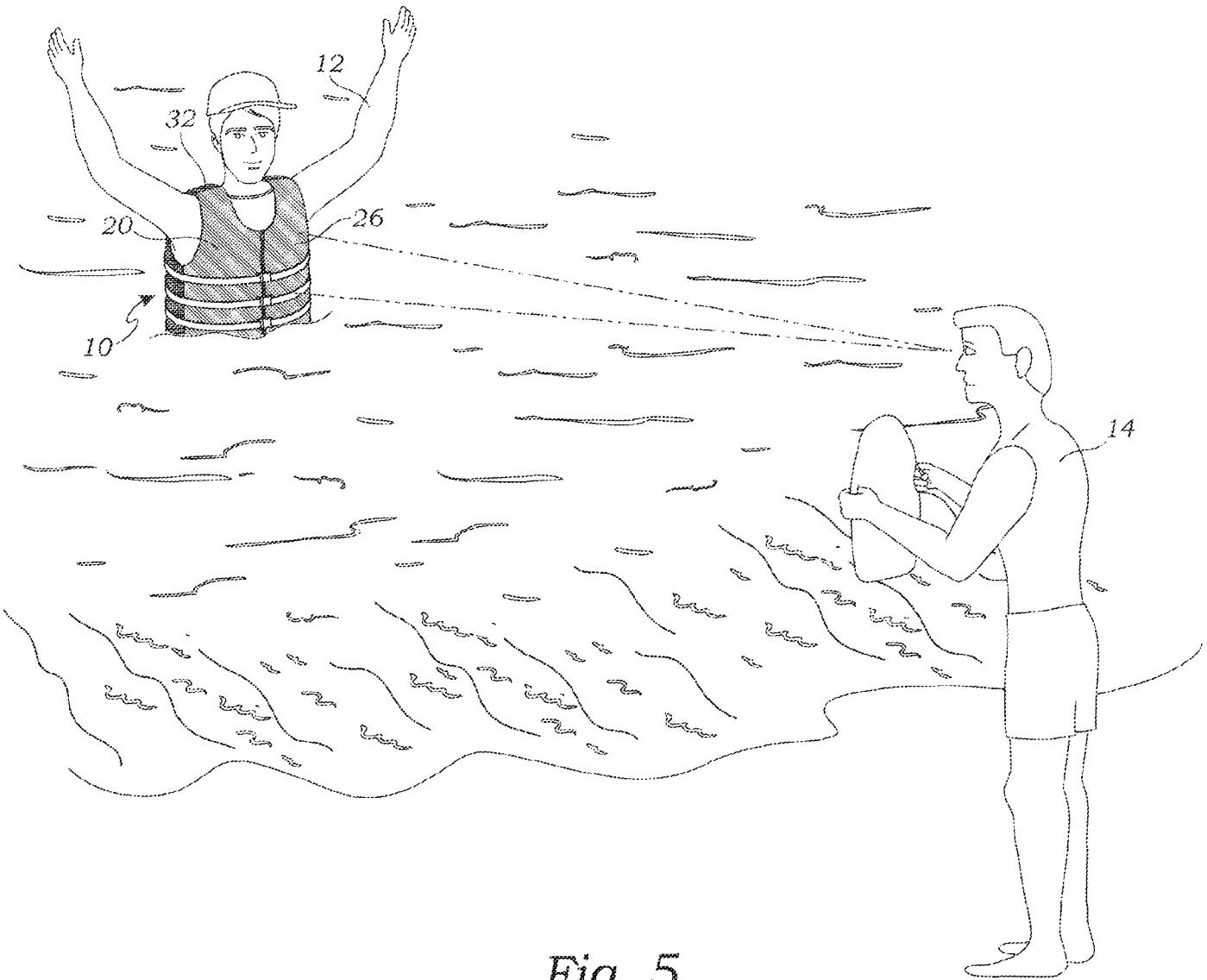
FIG. 5 is a perspective view of the person wearing the flotation vest in a rescue situation.

FIG. 5 is a perspective view of the person 12 wearing the flotation vest 10 in a rescue situation. As shown in FIG. 5, the invention includes a method of monitoring the person 12. The method includes providing the flotation vest 10 having the vest body 20 with the first florescent color 26 and the second fluorescent color 32. The flotation vest 10 is placed on the person 12, and the person 12 is observed wearing the flotation vest 10. The observing party 14 discerns which color 26 or 32 is visible. The observing party 14 then determines the orientation of the person 12 based upon the color 26 or 32 that is visible. In one embodiment, the method includes the step of adjusting a rescue method based upon the orientation of the person 12. For example, using this method a lifeguard 14 could adjust his rescue method after seeing the person 12 wearing the flotation vest 10 and observing which color 26 or 32 is visible. In this manner, a more safe and accurate rescue method may be attempted.

The terminology used in the specification provided above is hereby defined to include similar and/or equivalent terms, and/or alternative embodiments that would be considered obvious to one skilled in the art given the teachings of the present patent application. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A safety vest comprising:

a vest body adapted to cover a human torso, the vest body having an outer surface and an opposed inner surface, the inner surface contacting the human torso when worn;

a front panel of the vest body having a first fluorescent color, the first fluorescent color being disposed on a first outer surface of the vest body; and a back panel of the vest body having a second fluorescent color that is different than the first fluorescent color, the second fluorescent color being disposed on a second outer surface of the vest body, the front panel and the back panel being joined together to form the vest body and cover the human torso, with the front panel covering the front of the human torso and the back panel covering the back of the human torso.

2. The safety vest of claim 1, further comprising a plurality of utility pockets attached to front panel of the vest body.

3. The safety vest of claim 1, wherein the front panel and the back panel are bounded by a top edge, a pair of side edges, and a bottom edge, wherein the top edges of the front and back panels are connected to form a collar aperture and the respective side edges of the front and back panels are connected such that a first and second arm apertures are formed.

4. The safety vest of claim 1, further comprising an opening in the front panel adapted for putting the vest on a user and a fastener for releasably connecting the opening in a closed position.

5. The safety vest of claim 1, further comprising a band of retroreflective material on the vest body abutting the first and second outer surfaces of the vest body adjacent the first and second fluorescent colors.

6. The safety vest of claim 5, wherein a combined area of the front panel and the back panel is at least 217 $in^2$, the retroreflective material has an area of at least 155 $in^2$, and the band has a width of at least 25 mm.

7. The safety vest of claim 5, wherein a combined area of the front panel and the back panel is at least 775 $in^2$, the retroreflective material has an area of at least 201 $in^2$, and the band has a width of at least 35 mm.

8. The safety vest of claim 5, wherein a combined area of the front panel and the back panel is at least 1240 $in^2$, the retroreflective material has an area of at least 310 $in^2$, and the band has a width of at least 50 mm.

9. The safety vest of claim 5, wherein the band of retroreflective material encircles the torso of the user to provide 360° of visible reflective material.

10. The safety vest of claim 5, wherein the band of retroreflective material is at least 50 mm from a bottom edge of the vest body when running in a horizontal orientation.

11. A method of monitoring a person, the method comprising the steps of:

providing a vest having:

a vest body adapted to cover a human torso, the vest body having an outer surface and an opposed inner surface, the inner surface contacting the human torso when worn;

a front panel of the vest body having a first fluorescent color, the first fluorescent color being disposed on a first outer surface of the vest body; and a back panel of the vest body having a second fluorescent color that is different than the first fluorescent color, the second fluorescent color being disposed on a second outer surface of the vest body;

placing the vest on the person such that the first fluorescent color of the front panel is readily visible when he person is facing the viewer, and the second fluorescent color of the rear panel is readily visible when the person is facing away from the viewer;

observing the person wearing the vest;

discerning which color on the vest is visible; and determining the orientation of the person based upon the color that is visible.

* * * * *